US007163111B1

(12) United States Patent
Brodsky

(10) Patent No.: US 7,163,111 B1
(45) Date of Patent: Jan. 16, 2007

(54) VACUUM FORMED DISPLAY AND METHOD OF MAKING THE SAME

(76) Inventor: Elliott J. Brodsky, 45 Balton Rd., Providence, RI (US) 02906

( * ) Notice: Subject to any disclaimer, the term of this patent is extended or adjusted under 35 U.S.C. 154(b) by 286 days.

(21) Appl. No.: 10/716,774

(22) Filed: Nov. 19, 2003

(51) Int. Cl.
*A47F 5/08* (2006.01)

(52) U.S. Cl. ..... 211/150

(58) Field of Classification Search ..... 211/150, 211/134, 90.01, 81, 96, 168
See application file for complete search history.

(56) References Cited

U.S. PATENT DOCUMENTS 4,322,005 A 3/1982 Robertson
4,493,424 A 1/1985 Smith
4,618,115 A 10/1986 Belokin, Jr.
5,315,936 A 5/1994 Smith
5,678,492 A 10/1997 Pinkstone et al.
6,230,907 B1 * 5/2001 Stuart ..... 211/90.01
6,578,498 B1 * 6/2003 Draudt et al. ..... 108/50.02

* cited by examiner

*Primary Examiner*—Sarah Purol
(74) *Attorney, Agent, or Firm*—Salter & Michaelson

(57) ABSTRACT

A vacuum formed display includes a body portion, and one or more shelves having at least one partition formed as a unitary display. The shelves may also include other details such as a raised front lip. The shelves are vacuum formed in a flat position, and lie generally in the same plane as a back wall of the display. In this manner, the display can be readily removed from the mold. The perimeter of the shelves, with the exception of a living hinge portion which connects the shelf to the display, are preferably die cut. The shelves are then pivoted to a horizontal position where they are supported between opposing side walls of the display. In one embodiment, integrally molded support ledges provide a support for the shelves. Cooperating detents may also be provided on the inner surface of the side walls in order to hold the shelves more securely.

17 Claims, 12 Drawing Sheets

VACUUM FORMED DISPLAY AND METHOD OF MAKING THE SAME

TECHNICAL FIELD

The present disclosure is directed to a display having horizontal shelves, and more particularly, to an improved vacuum formed display having horizontal shelves with at least one partition to define separate compartments within the shelf.

BACKGROUND OF RELATED ART

Vacuum forming as a method of molding a display is well known in the art. In order to vacuum form the display a mold is utilized with a heat-softened sheet of plastic. Typically, the mold is porous or includes holes in a forming surface, and a vacuum is applied which evacuates air from between the surface and the heat-softened plastic sheet to bring the sheet into conformance with the surface. In this manner the sheet takes the shape of the surface of the mold. The completed product is then removed from the mold.

Vacuum formed displays are generally integrally molded to include a top, side and bottom walls, with shelves extending horizontally there across. Vacuum forming is a reliable and cost effective method to create such types of displays. However, it is sometimes desirable to have additional elements formed in the display, for example, shelves having a front lip, and/or partitions extending from the front to the back of the shelf to define separate compartments within the shelf to house items. In the past, it has not been possible to vacuum form a display including shelves with features such as front lips and/or partitions, because the lips and partitions on the shelves make it impossible to remove the vacuum formed display from the mold due to the undercuts defined by the front lip and/or front to rear partitions. In some cases, where shelves having these features are required, the shelves are molded separately and then attached in some mechanical way to the display, which itself is integrally molded without any shelves. This results in a product which is more labor intensive, causing an increase in product cost, and also makes it more likely that difficulties will result when assembling the shelves.

Other methods of forming displays also exist, other than vacuum forming. For example, it is well known to form displays from cardboard blanks that are folded and manipulated which results in the display having a plurality of shelves. One such display is illustrated in U.S. Pat. No. 5,678,492 to Pinkstone et al. which discloses a display box with shelving formed from a single panel. In the '492 patent, a multi-tier display rack is formed from a flat, blank of sheet material including four panels which create a front, rear and opposed side walls of the display rack in the assembled position. In one embodiment, one panel includes sections which are partially punched out to form shelves of the display rack when assembled. Each shelf includes a slot therethrough. Another panel includes locking tabs which are partially punched out and pushed through the slots to lock the shelves in place. While generally effective, displays of this type lack the advantages of vacuum forming, namely, the ease of manufacture to produce multiple displays in a cost effective manner.

While a variety of methods for making displays including shelves exist today, there is continued need in the art for producing displays having shelves with partitions and/or lips, in a readily reproducible and cost effective manner.

SUMMARY

It is therefore an object of the vacuum formed display disclosed herein to provide a display and method of making the same which is readily reproducible, cost effective, and which can be utilized to produce a display having shelves including partitions to create one or more multiple compartments, as well as other details such as a front lip, or the like.

The vacuum formed display includes a body portion, and one or more shelves integrally formed with the body portion during vacuum forming. The shelves may have one or more partitions, and include other details such as a raised lip along the front portion of the shelf, as desired. To achieve a display having this configuration, when the display is vacuum formed, the shelves are initially in a flat position, and lie generally in the same plane as a back wall of the display. In this manner, the display (including the shelves) can be readily removed from the mold. Once the mold is removed, the perimeter of the shelves, with the exception of a living hinge portion which connects the shelf to the display, are die cut to separate the body of the shelves from the back wall of the display. The shelves are then pivoted to a horizontal position where they are supported between opposing side walls of the display. In one embodiment, integrally molded support ledges which extend inwardly from the side walls of the interior of the display provide a support for holding the shelves in their desired horizontal position. The structure of the support ledges provides the shelves with sufficient support so that products may be placed on the shelves during use. In another embodiment, cooperating detents may be provided on the inner surface of the side walls of the display, and above the support ledges, in order to hold the shelves more securely in the horizontal display position. As will be appreciated, when the shelves are die cut and pivoted to their horizontal position, a corresponding opening remains on the back wall of the display. This opening may be covered by securing a printed card or sticker to the back of the display. The card may include any desired product information, advertising message or other indicia. Alternately, the opening may remain and the display may be mounted to a suitable backing.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
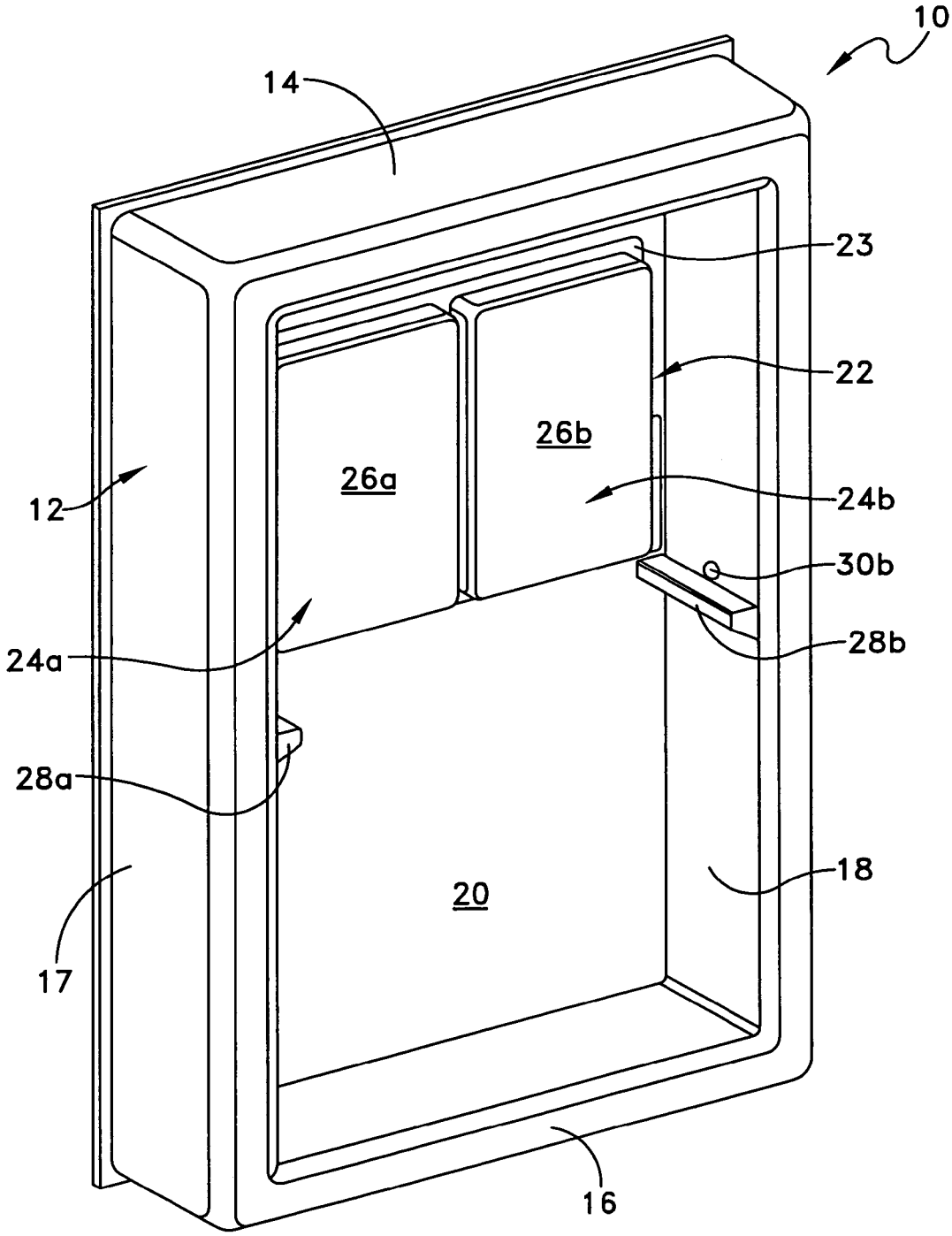
FIG. 1 is a front perspective view of a vacuum formed display as disclosed herein prior to assembly.
Figure 2:
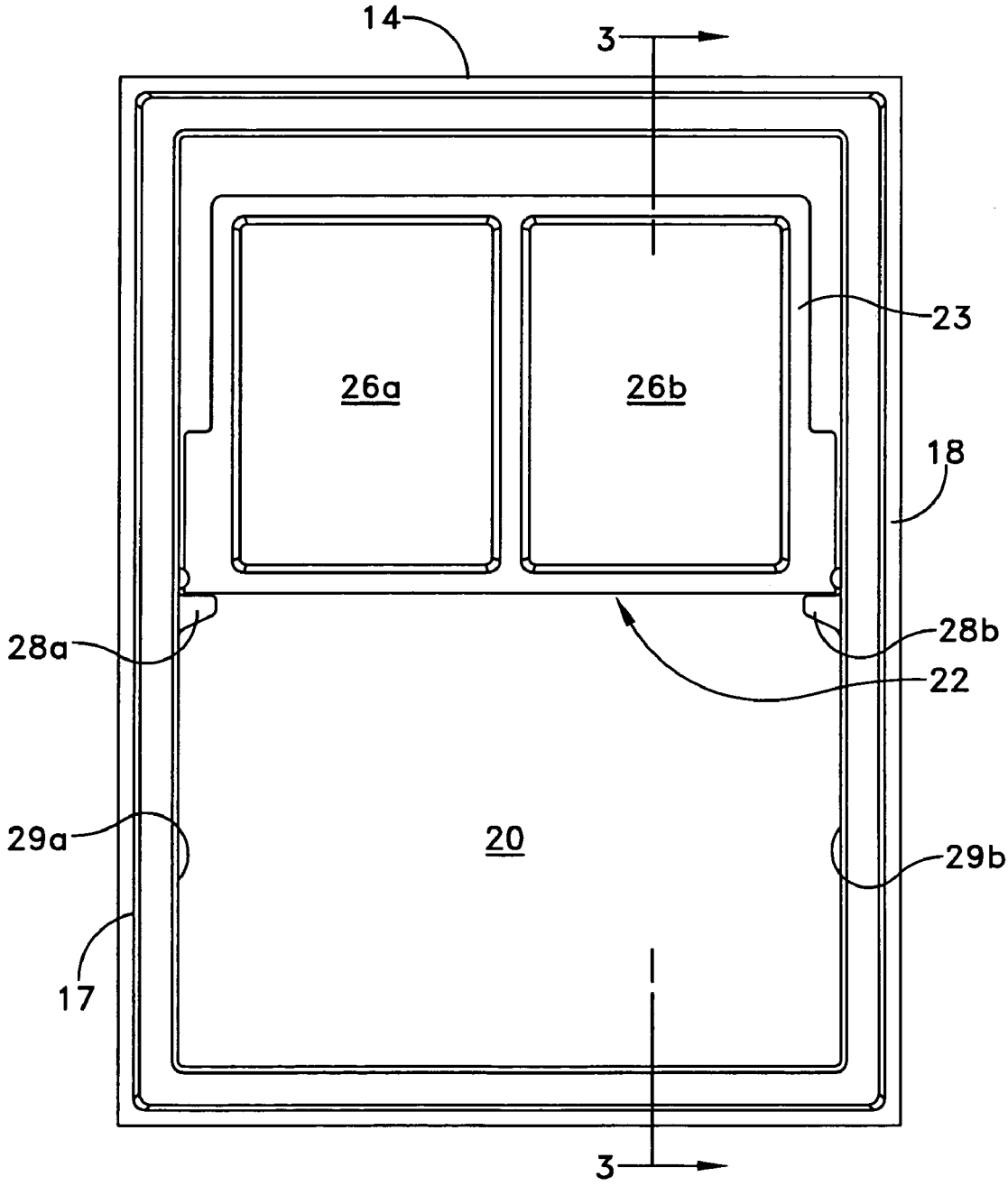
FIG. 2 is a front elevational view of the embodiment of FIG. 1.
Figure 3:
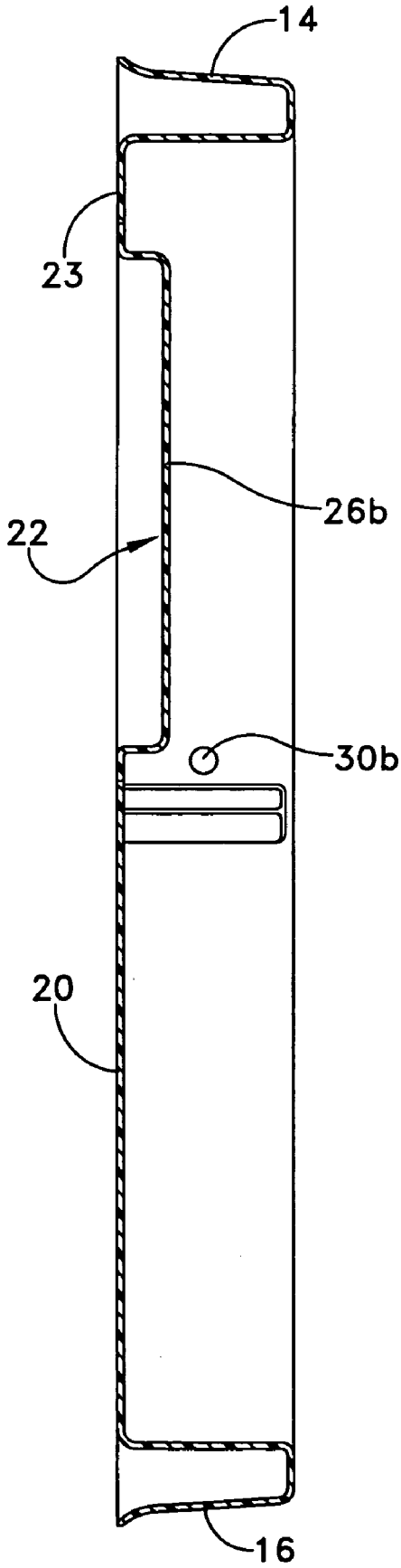
FIG. 3 is a cross sectional view taken along lines 3—3 of FIG. 2.
Figure 4:
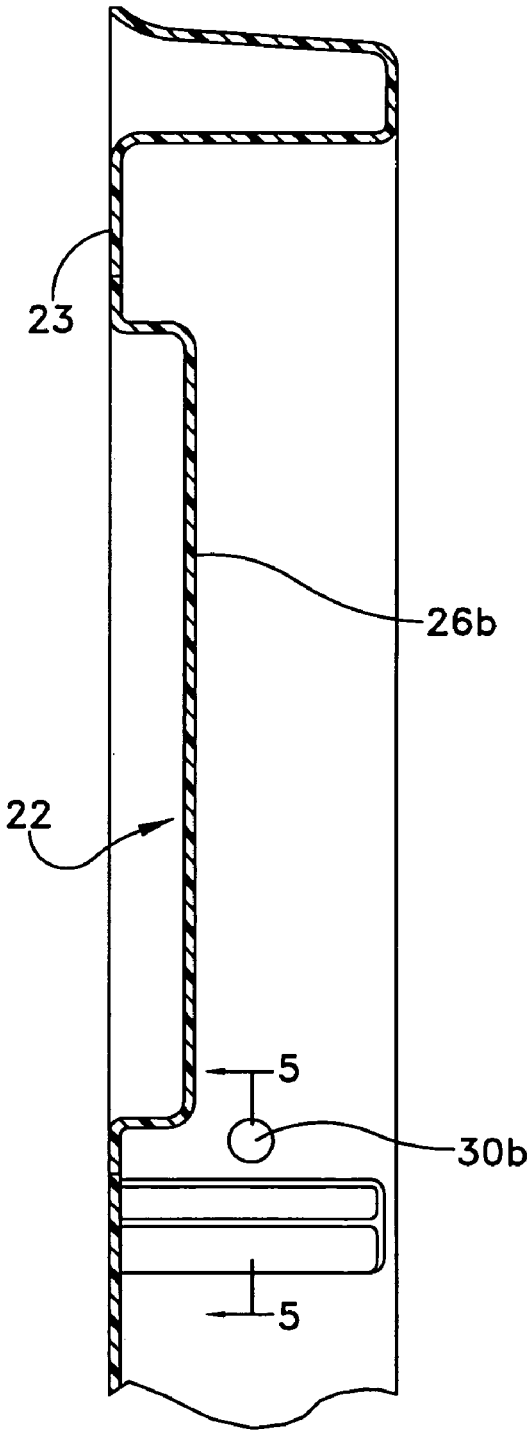
FIG. 4 is an enlarged cross sectional view of the top portion of FIG. 3.
Figure 5:
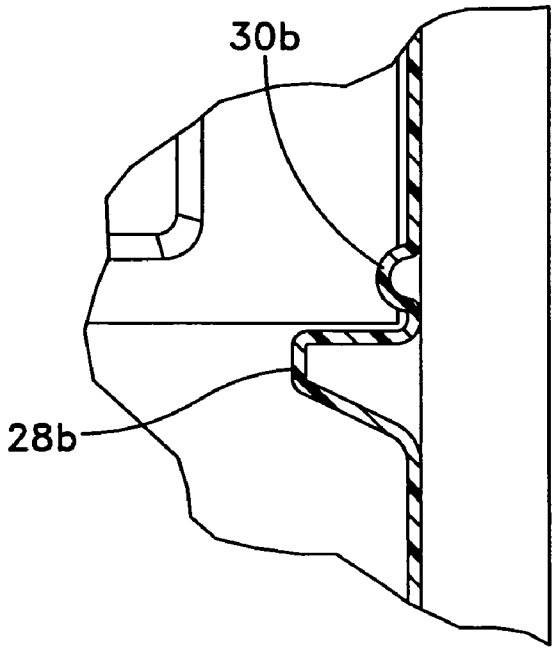
FIG. 5 is a cross sectional view taken along lines 5—5 of FIG. 4.

A vacuum formed display 10 includes a body portion 12 having a top wall 14, a bottom wall 16, opposing side walls 17, 18, back wall 20, and one or more shelves 22, as shown in FIGS. 1–13. In the present embodiment, a single shelf 22 is illustrated which includes a pair of compartments 24*a*, 24*b* for holding and displaying articles, although any number of shelves and/or compartments may be formed in the display as would be known to one of skill in the art. The shelf 22 is formed as a unitary piece with the body portion 12, such that perimeter 23 of the shelf lies generally in the same plane as the back wall 20 of the display. Likewise, the back 26*a*, 26*b* of the compartments lie in a plane generally parallel to the plane of the back wall 20. Because the shelves and any compartments are parallel to the plane of the back wall, once the display is molded it can be readily removed from the mold without difficulty, as described in greater detail below. In the present embodiment, a pair of support ledges 28*a*, 28*b* may also be molded as unitary members of the body portion 12. The support ledges 28*a*, 28*b* are preferably molded on an inner surface 29*a*, 29*b* of opposing side walls 16, 18, and are positioned along the inner surface in order to provide support to the shelf 22 when it is rotated into the assembled position. A pair of cooperative detents 30*a*, 30*b* may also be provided on the inner surface of the opposing side walls 16, 18, spaced just above each of the ledges. The detents lend additional support to the shelf when it is pivoted into the assembled position, as discussed below.

Figure 6:
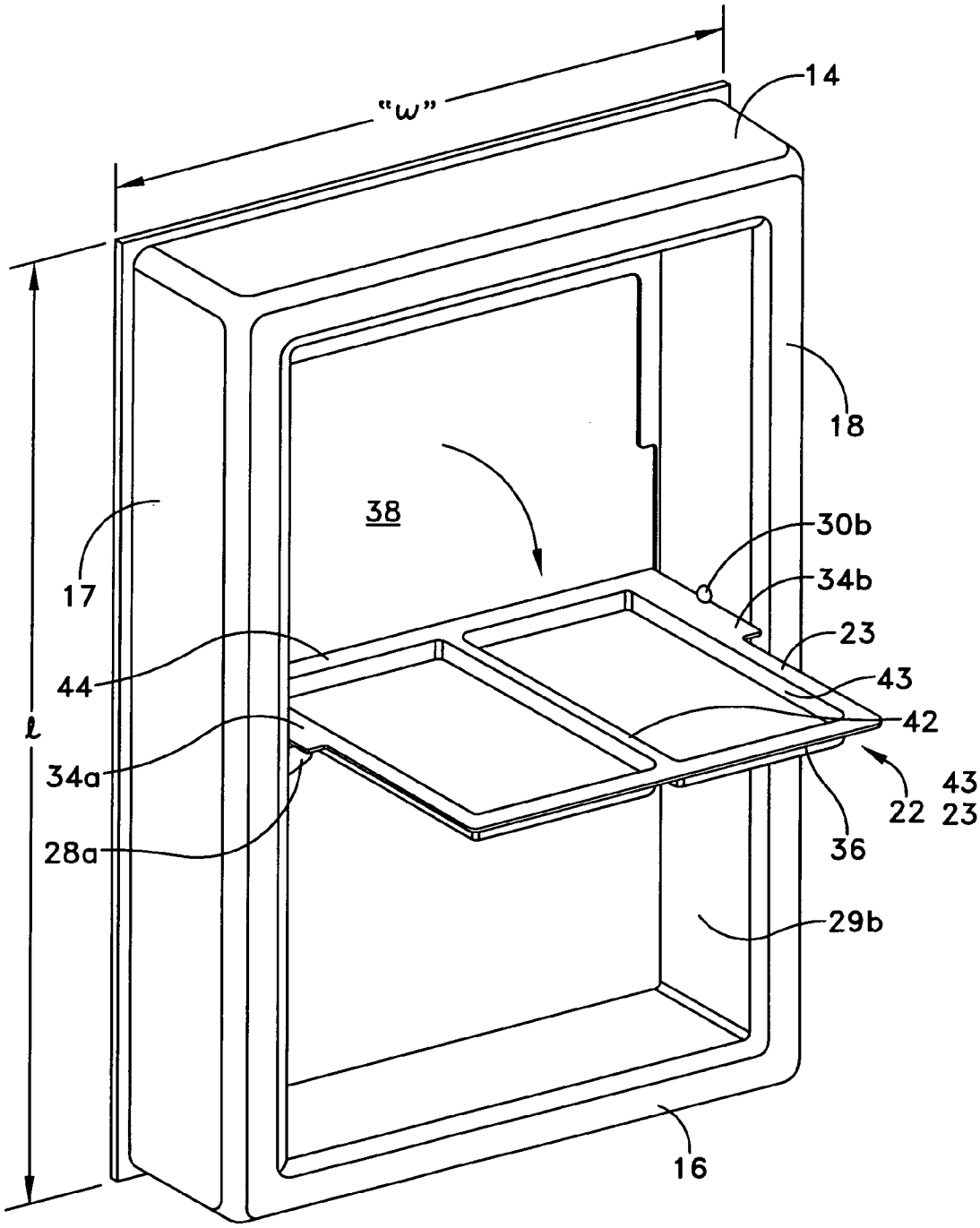
FIG. 6 is a front perspective view of the embodiment of FIG. 1 illustrating movement of the shelf into the engaged or display position.
Figure 7:
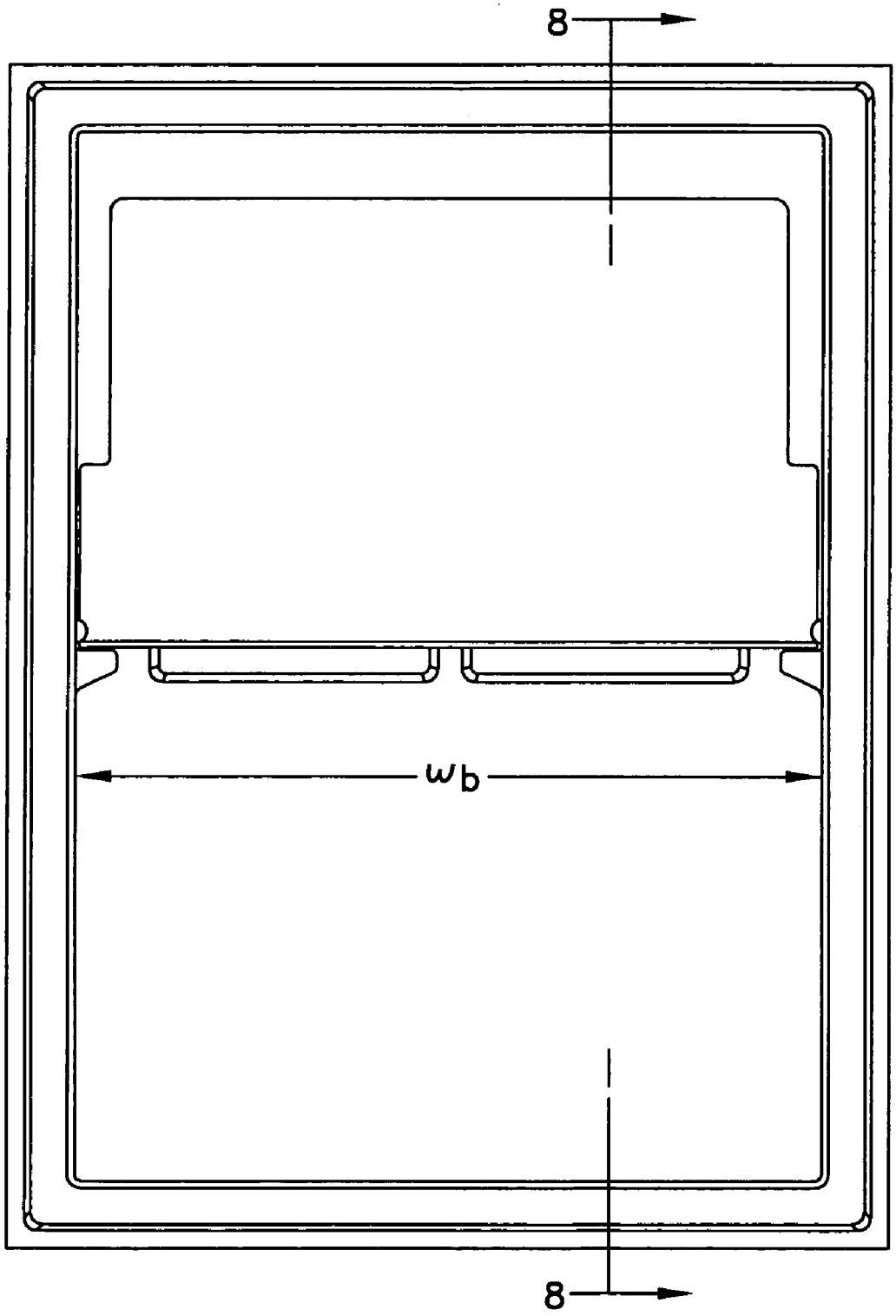
FIG. 7 is a front elevational view of FIG. 6.
Figure 8:
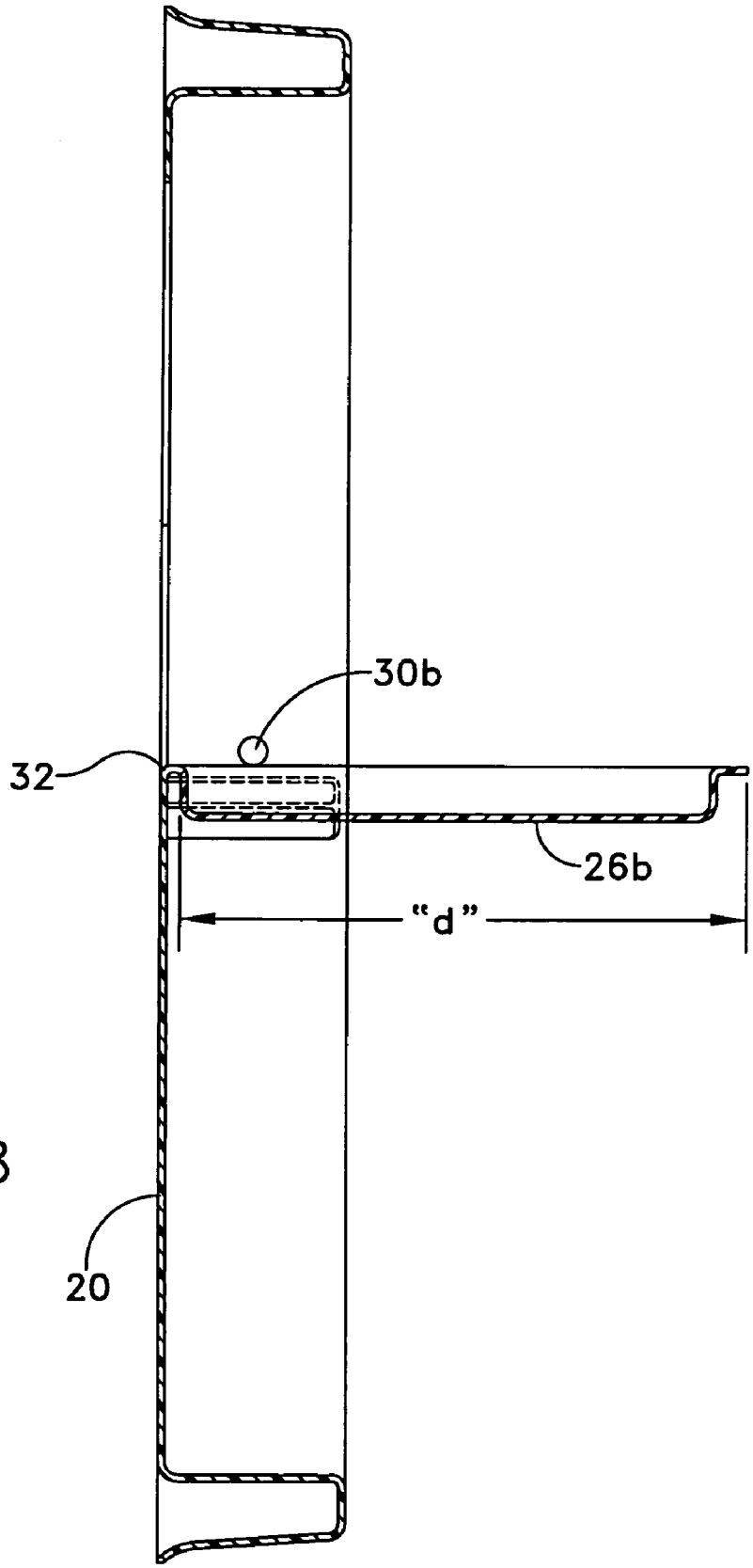
FIG. 8 is a cross sectional view taken along lines 8—8 of FIG. 7.
Figure 9:
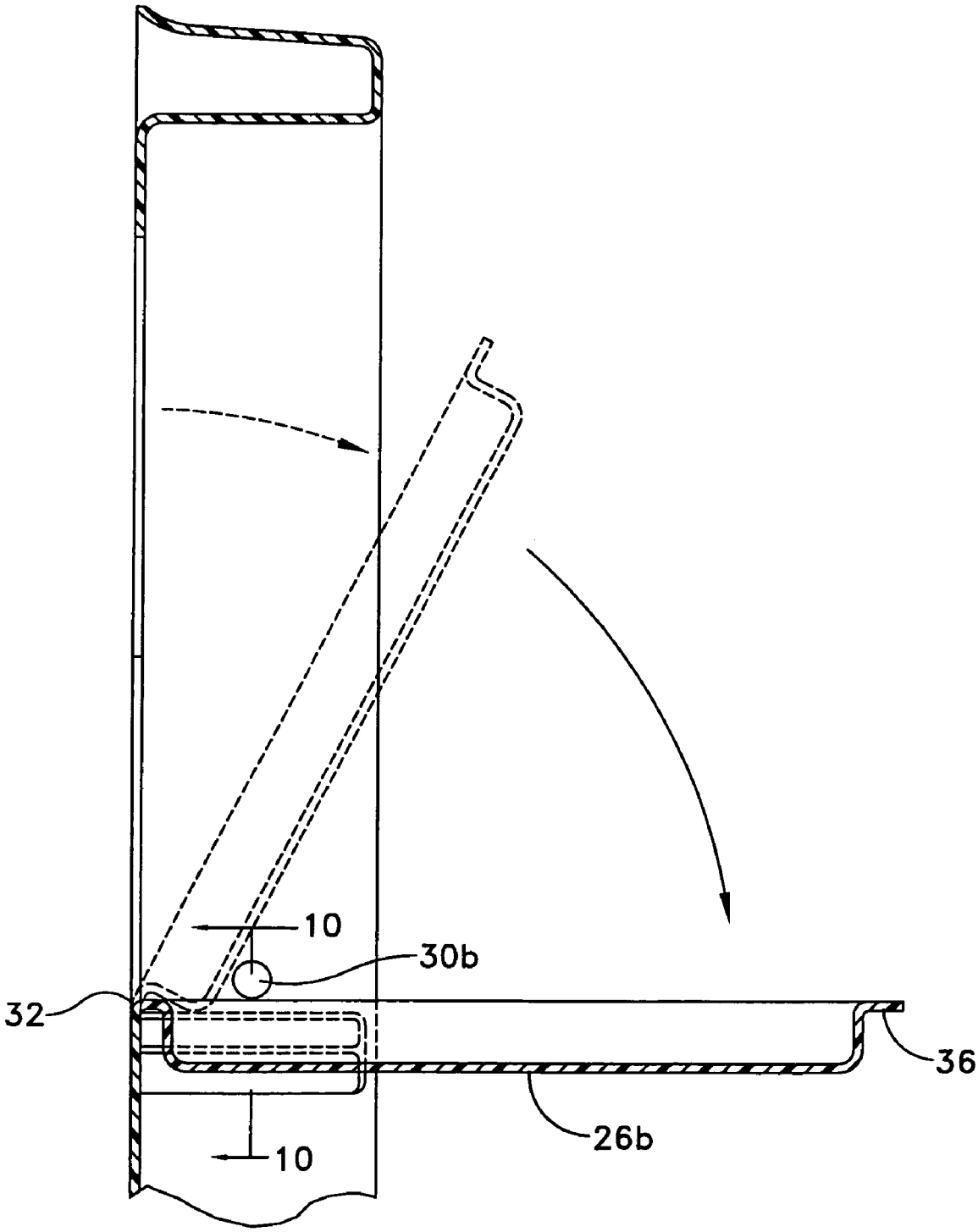
FIG. 9 is a side cross sectional view showing the shelf moving from the upward or non-assembled position to the lowered or assembled position.
Figure 10:
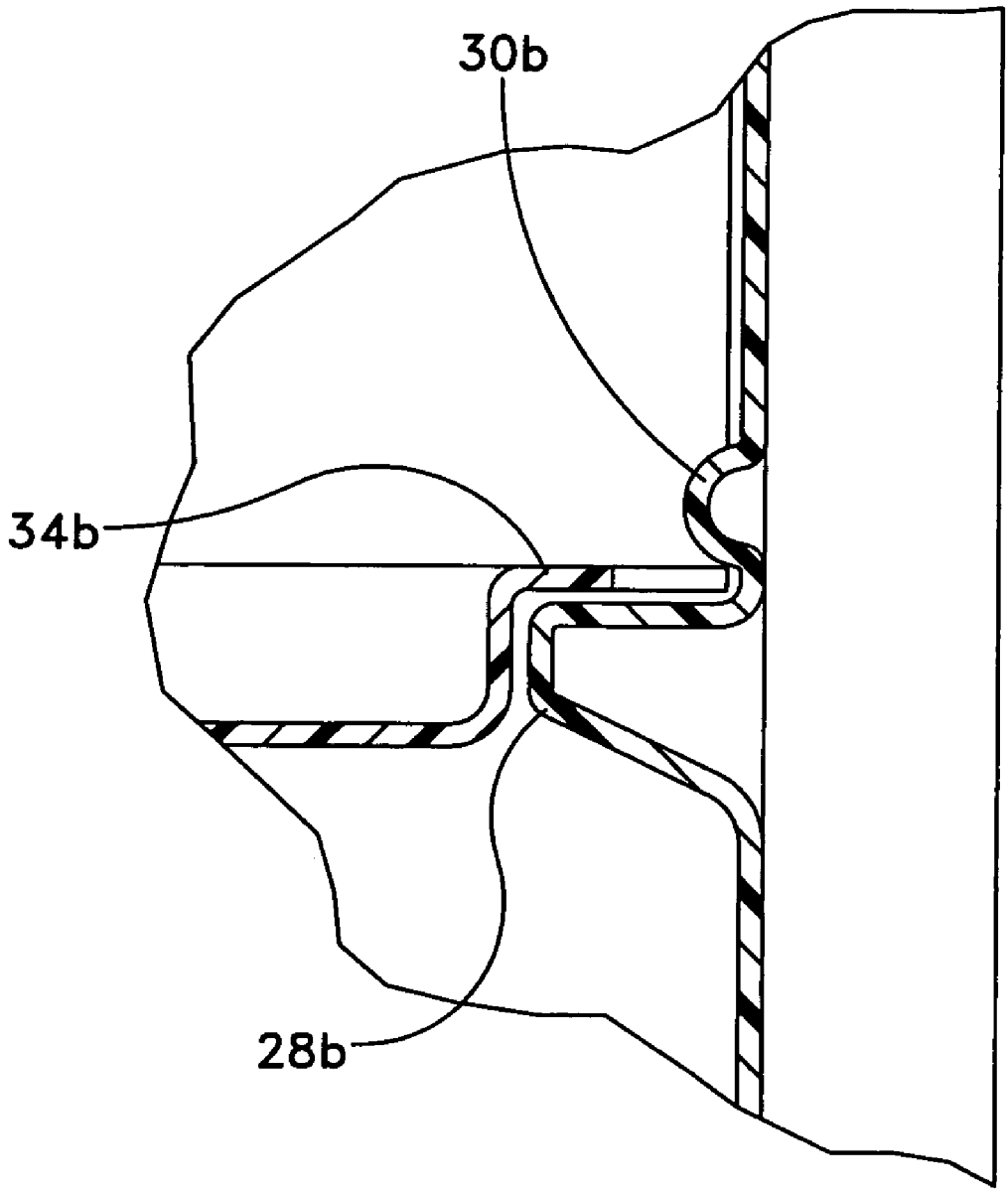
FIG. 10 is a cross sectional view taken along lines 10—10 of FIG. 8(?)
Figure 11:
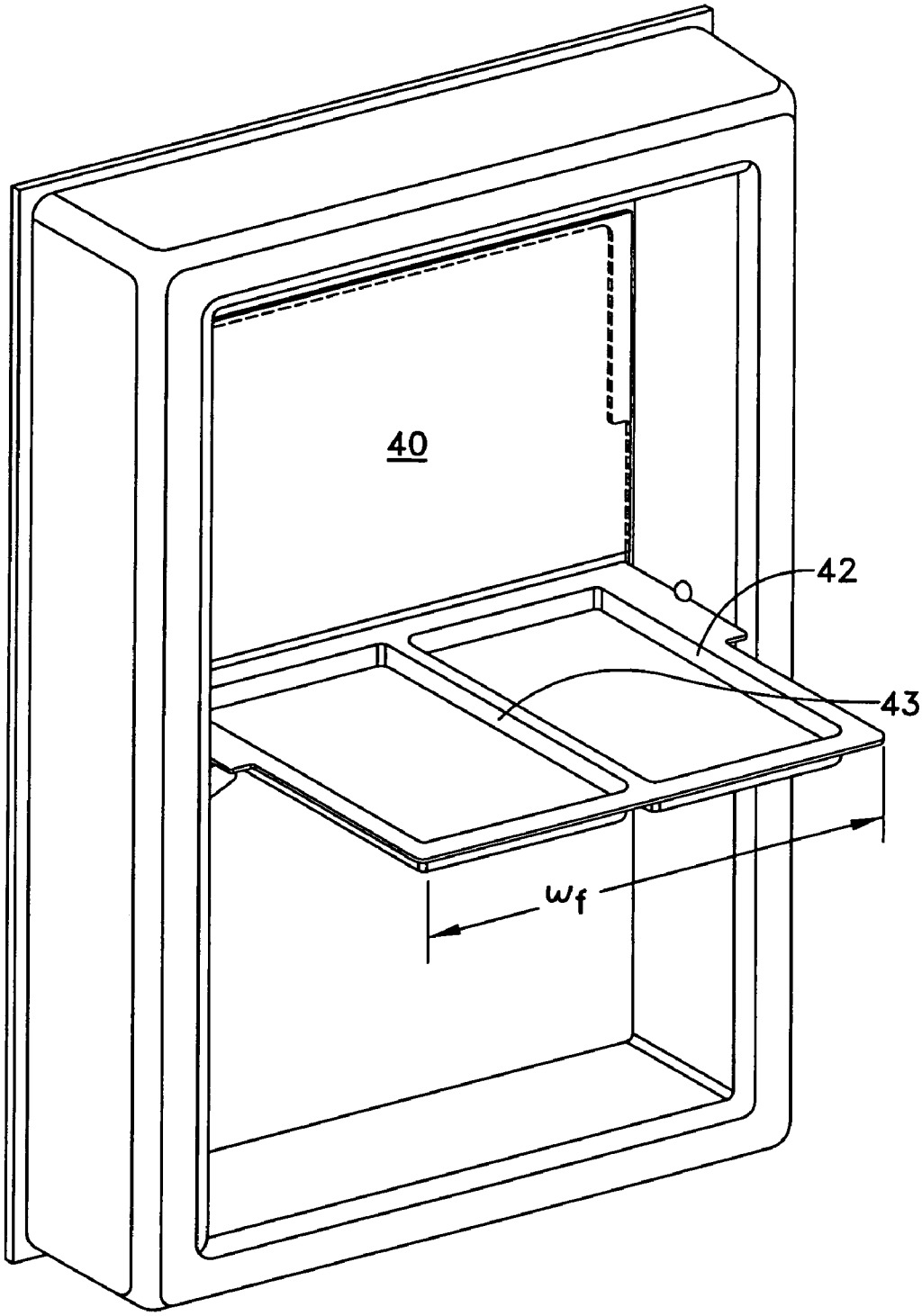
FIG. 11 is a front perspective view of the vacuum formed display of FIG. 1 in the showing the shelf in the fully engaged display position.
Figure 12:
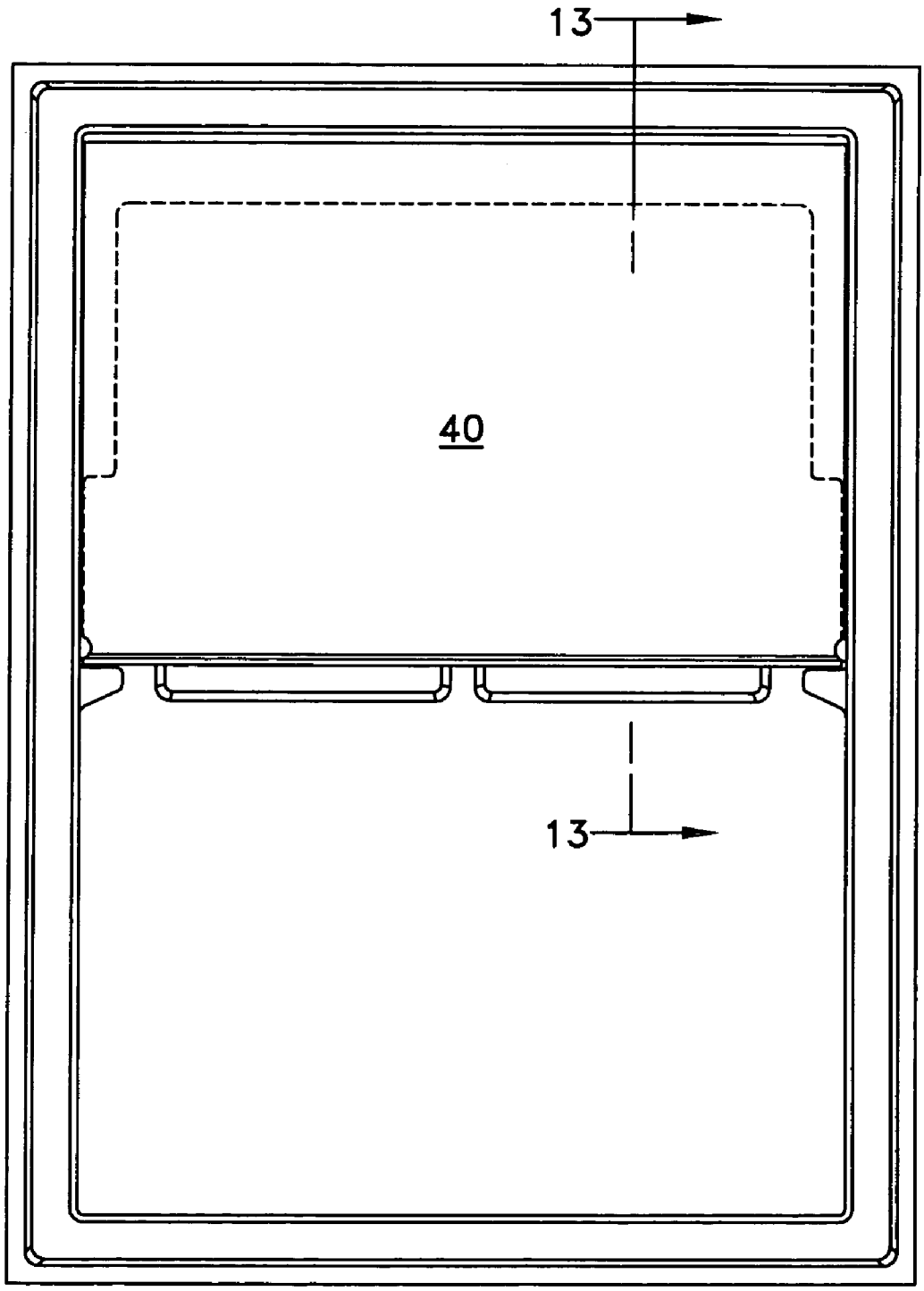
FIG. 12 is a front perspective view of FIG. 11.
Figure 13:
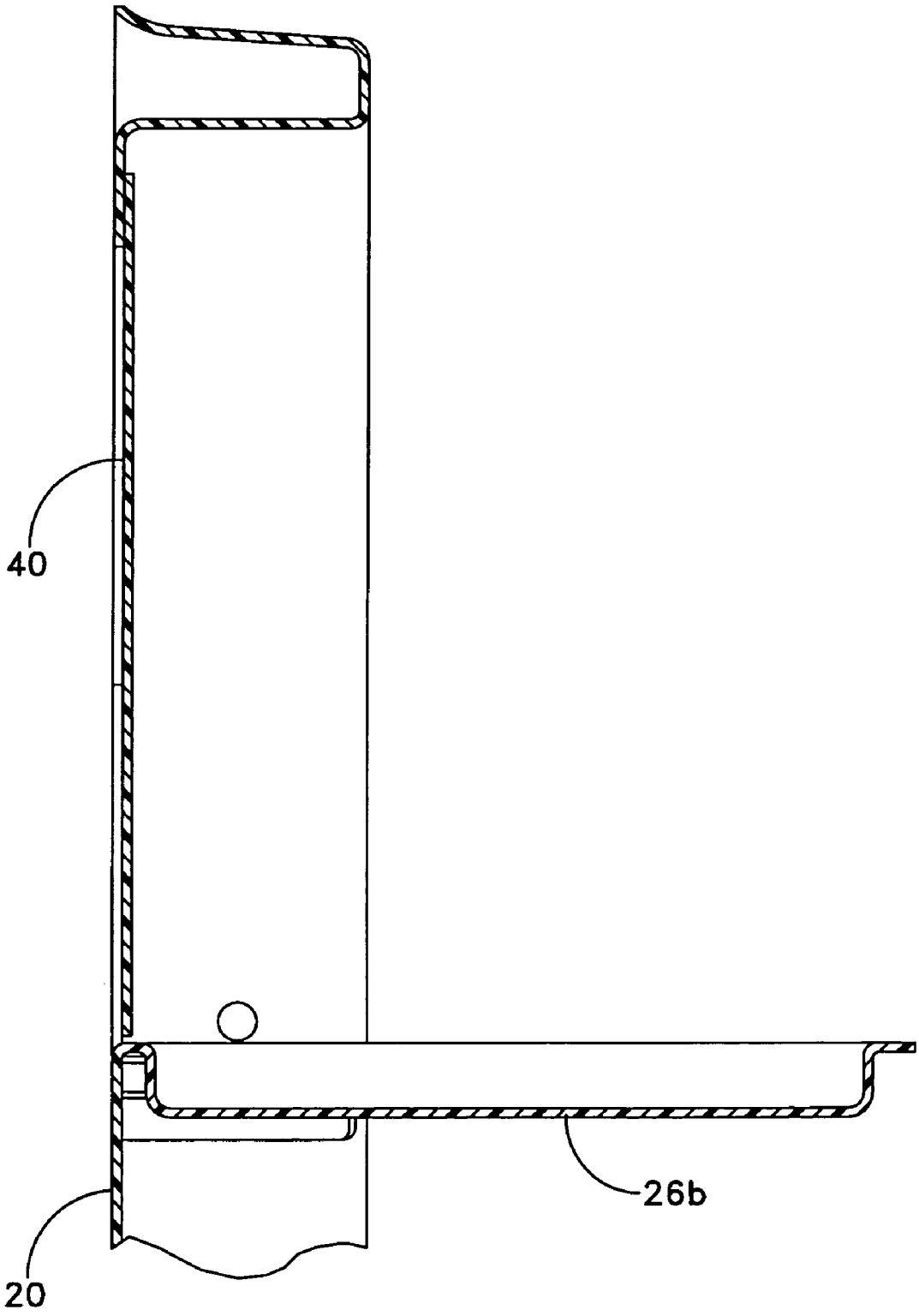
FIG. 13 is a cross sectional view taken along lines 13—13 of FIG. 12.

Referring now to FIGS. 2–10, in order to assemble the display and move the shelf 22 from the non-assembled, molding position (FIG. 2) to the assembled, display position (FIG. 6), the perimeter 23 of the shelf is separated from the back wall 20 of the display. In the present embodiment, the perimeter of the shelf is die cut with the exception of a living hinge 32 (FIG. 8), which remains connected to the back wall 20 in order to provide the connection between the shelf 22 and the display. As best shown in FIG. 6, the perimeter 23 of the shelf 22 may be cut such that a pair of tabs 34*a*, 34*b* are formed which extend from the shelves, toward the inner surface 29*a*, 29*b* of the opposing side walls 17, 18, respectively. The tabs 34*a*, 34*b* may be provided to give additional support to the shelf once assembled. The tabs are preferably sized so that they are supported on corresponding ledges 28*a*, 28*b*, and under detents 30*a*, 30*b* in order to lock shelf 22 in place, in the present embodiment (FIG. 8). The front portion, or forward lip 36 of the perimeter 23 may preferably be cut inward from the tabs, so that a sufficient clearance is formed between the inner surface of the side walls and the front portion of the shelf in order to aid in rotating the shelf into the assembled position.

Once the shelf 22 has been die cut from the display and moved into the assembled position, a corresponding opening 38 remains in the back of the display. In order to provide a more finished look to the display, the opening 38 may be covered by securing a sticker or card 40 (FIG. 11) over the opening. The card 40 may include any desired information, or indicia, such as product information or advertising, as desired. Alternately, the opening may remain and the display may be mounted to a suitable backing.

The display 10, and one or more shelves 22 may be any of a number of shapes and have a variety of sizes, as would be known to those of skill in the art. In the present embodiment, the display has a rectangular shape with the length, "l", of the display from the outer edge of the top wall to the outer edge of the bottom wall being about 19.5 inches, and the width, "w", from the outer edge of one side wall to the outer edge of the other side wall being about 15 inches. The shelf 22 may also have a variety of shapes and sizes, depending upon the shape and dimensions of the body of the display. In the present embodiment, the shelf 22 has a depth, "d", (FIG. 8) of about 6.5 inches, and has a width ("$w_b$") of about 11.75 inches at the back, including tabs 34*a*, 34*b*, and a width ("$w_f$") of about 11 inches at the front lip. The shelf may include one or more compartments. In the present embodiment, the shelf 22 includes a partition or raised wall 42 which divides the shelf into two compartments 24*a*, 24*b*. In the present embodiment, partition 42 extends from the front portion 36 to the rear portion 44 of the shelf. Each of the two compartments 24*a*, 24*b* have a bottom or base 26*a*, 26*b* to support a product thereon. The base of each compartment may further include a raised wall, or lip, extending along the perimeter of the base. As will be appreciated, the size and shapes of the compartments may readily be varied, as would be known to those of skill in the art. In addition, although the present embodiment illustrates the compartments 24*a*, 24*b* being bounded on all sides by a raised wall 43, the shelf may alternately include only a raised front lip in order to prevent product from sliding off the shelf. In such a case the shelf may include a single large compartment, if desired.

A method of making a vacuum formed display including at least one shelf having a raised wall to define separate compartments, or a lip, will now be described with reference to the drawings.

As shown in FIGS. 1–5 the display 10 is initially vacuum molded such that the body portion 12 and shelf 22 are a single, unitary display. In this unassembled position, the shelf 22 lies in a vertical plane defined by the back wall 20 of the display, with the compartments 24*a*, 24*b* laying substantially parallel to the vertical plane. The display is vacuum formed using conventional techniques, as known to those of skill in the art. Once the vacuum forming is complete, the mold can be readily removed, as conventional, because the shelf 22 and any compartments and/or lips are positioned parallel to the plane of the back wall 20 of the display. There are no undercuts present in the unassembled position to prevent the display from being removed from the mold. Once the display is removed from the mold the shelf 22 is cut around its perimeter 23 so that it can be separated from the back wall 20 of the display and moved into the assembled position (FIG. 6). When the shelf is cut, it is preferably cut along three sides only, so that it remains connected to the back wall along one side by a living hinge 32. In the illustrated embodiment, the shelf is cut along opposing sides and a top edge so that it remains connected at a bottom edge. Alternately, the shelf could be cut along the bottom and size edges and remain connected at the top edge. In either case, once the shelf has been cut it is pivoted (downward in the present embodiment) into the horizontal position, where the shelf lies in a plane substantially perpendicular to the plane of the back wall. The display may be molded with a pair of optional support ledges 28*a*, 28*b* on the inner surface of opposing side walls 16, 18, in order to provide support to the shelf 22 when it is rotated into the assembled position. A pair of cooperative detents 30*a*, 30*b* may also be provided on the inner surface of the opposing side walls 16, 18, spaced just above each of the ledges. The detents lend additional support to the shelf and aid in locking the shelf it in place when it is pivoted into the assembled position, as discussed below. If ledges 28*a*, 28*b* are provided, it is desirable to cut the shelf along the perimeter so that a pair of tabs 34*a*, 34*b* are formed which extend from the shelf, toward the inner surface of the opposing side walls 16, 18. The tabs are sized so that they are supported on corresponding ledges 28*a*, 28*b*, and under detents 30*a*, 30*b* in order to lock shelf 22 in place, in the present embodiment (FIG. 8). Once the shelf is cut, pivoted and locked in place, a corresponding opening 38 remains in the back of the display. In order to provide a more finished look to the display, the opening 38 may be covered by securing a sticker or card 40 (FIG. 9) over the opening. The card 40 may include any desired information, or indicia, such as product information or advertising, as desired.

The display and method of making the same disclosed herein is readily reproducible, cost effective, and can be utilized to produce a display having shelves including one or more multiple compartments, as well as other details such as a front lip, or the like.

It will be understood that various modifications may be made to the embodiments disclosed herein. For example, the shape and size of the display, shelves and compartments may be readily varied, as would be known to those of skill in the art. In addition, the number of compartments and shelves may be varied. Also, the shelves may be pivoted upward, instead of downward, as would be known to those of skill in the art. Therefore, the above description should not be construed as limiting, but merely as exemplifications of preferred embodiments. Those skilled in the art will envision other modifications within the scope, spirit and intent of the invention.

What is claimed is:

1. A vacuum formed display comprising:

a body portion having a top wall, a bottom wall, a back wall and opposing side walls;

at least one shelf, the shelf being vacuum formed as a unitary piece with the body portion, such that a perimeter of the shelf lies generally in the same plane as the back wall;

the perimeter of said shelf defined by a separated portion and a hinged portion; and wherein to assemble the display, the shelf is separated from the back wall of the display along said separated portion of the perimeter such that the shelf is pivotal about said hinged portion to a position where the perimeter of the shelf is substantially perpendicular to the back wall of the display, the shelf being supported in the assembled position by at least the back wall of the display.

2. The display of claim 1, further comprising a pair of support ledges molded on an inner surface of the opposing side walls as unitary members with the side walls, and constructed and arranged to provide support to the at least one shelf in the assembled position.

3. The display of claim 2, further comprising a pair of detents molded on the inner surface of the opposing side walls, spaced above each of the ledges, the detents being constructed and arranged to provide additional support to the at least one shelf in the assembled position.

4. The display of claim 2, wherein the perimeter of the at least one shelf includes a pair of tabs extending from a rear portion of the at least one shelf, the pair of tabs being constructed and arranged to support the at least one shelf on the pair of ledges.

5. The display of claim 1, further comprising an opening disposed in the back of the display and further comprising a card disposed over the opening, the card including indicia.

6. The display of claim 1 further including at least one partition constructed and arranged to separate the shelf into one or more compartments.

7. The display of claim 1, wherein the shelf is separated by a cut along a top portion and side portions of the separated portion.

8. A vacuum formed display comprising:

a body portion having a top wall, a bottom wall, a back wall and opposing side walls;

at least one shelf, the shelf being vacuum formed as a unitary piece with the body portion, such that a perimeter of the shelf lies generally in the same plane as the back wall;

the perimeter of said shelf defined by a separated portion and a hinged portion;

wherein the perimeter of the at least one shelf includes a pair of tabs extending from a rear portion of the at least one shelf, the pair of tabs being constructed and arranged to aid in supporting the at least one shelf;

a pair of support ledges molded on an inner surface of the opposing side walls as unitary members with the side walls, and constructed and arranged to provide support to the at least one shelf in an assembled position;

a pair of detents molded on the inner surface of the opposing side walls, spaced just above each of the ledges, the detents being constructed and arranged to provide additional support to the at least one shelf in the assembled position; and wherein to assemble the display, the shelf is separated from the back wall of the display along said separated portion of the perimeter such that the shelf is pivotal about said hinged position to a position where a base of the shelf is substantially perpendicular to the back wall of the display, the shelf being supported in the assembled position by at least the back wall of the display.

9. The display of claim 8 further comprising an opening disposed in the back of the display and further comprising a card disposed over the opening, the card including indicia.

10. The display of claim 8 further including at least one partition constructed and arranged to separate the shelf into one or more compartments.

11. A vacuum formed display comprising:

a body portion having at least a back wall and opposing side walls;

a shelf that is vacuum formed as a unitary piece with the body portion and including a shelf perimeter;

the perimeter of said shelf defined by a separated portion and a hinged portion;

said shelf adapted to have an initially formed position and a usable position;

the perimeter of the shelf, in its initially formed position, lying generally in the same plane as the back wall;

said shelf being separated from the back wall along said separated portion so that the shelf is pivotal about said hinged portion to said usable position; and a pair of support ledges molded on an inner surface of the opposing side walls as unitary members with the side walls, and constructed and arranged to provide support for the shelf in said usable position.

12. The display of claim 11 wherein the perimeter of the shelf includes a pair of tabs extending from opposite side portions of the separated portion of the shelf, said pair of tabs being constructed and arranged for support on said respective support ledges.

13. The display of claim 11 further including a pair of detents molded on the inner surface of the opposing side walls, spaced just above each of the ledges, the detents being constructed and arranged on opposite sides of said shelf peripheral separated portion to provide additional support to the shelf in the usable position.

14. The display of claim 11 wherein the separated portion of the perimeter, in the usable position, is substantially perpendicular to the back wall.

15. The display of claim 11 further including at least one partition constructed and arranged to separate the shelf into one or more compartments.

16. The display of claim 11 wherein said shelf includes a base and a raised wall extending at least partially to define a compartment that enables support of a product.

17. The display of claim 11 further comprising an opening disposed in the back of the display and further comprising a card disposed over the opening, the card including indicia.

* * * * *